US008539865B1

(12) United States Patent
Zimmerman

(10) Patent No.: US 8,539,865 B1
(45) Date of Patent: Sep. 24, 2013

(54) HEX DRIVE SCREW HOLDER

(76) Inventor: Andreas Zimmerman, Chateauquay (CA)

( * ) Notice: Subject to any disclaimer, the term of this patent is extended or adjusted under 35 U.S.C. 154(b) by 260 days.

(21) Appl. No.: 13/220,815

(22) Filed: Aug. 30, 2011

(51) Int. Cl.
*B25B 23/10* (2006.01)

(52) U.S. Cl.
USPC ..... 81/456; 81/451

(58) Field of Classification Search
USPC ..... 81/451, 452, 454, 456–458
See application file for complete search history.

(56) References Cited

U.S. PATENT DOCUMENTS

| | | | | |
|---|---|---|---|---|
| 950,318 | A * | 2/1910 | Dunning | 81/457 |
| 4,800,788 | A | 1/1989 | Goldstein | |
| 4,936,169 | A | 6/1990 | Parsons | |
| 5,207,127 | A | 5/1993 | Nick | |
| 5,341,708 | A | 8/1994 | Nick | |
| 5,509,330 | A | 4/1996 | Nick | |
| 5,996,452 | A | 12/1999 | Chiang | |
| 6,082,233 | A | 7/2000 | Han | |
| 2005/0166725 | A1 | 8/2005 | Chen | |
| 2006/0075856 | A1 * | 4/2006 | Tilton | 81/452 |
| 2006/0278050 | A1 | 12/2006 | Hsiao | |

* cited by examiner

*Primary Examiner* — David B Thomas
(74) *Attorney, Agent, or Firm* — Kyle Fletcher

(57) ABSTRACT

The hex drive screw holder includes a spring-loaded end piece having a slot across which the neck of a screw may slide and of which engages and aligns the screw head against the screwdriver bit. The spring-loaded end piece is supported by opposing arms that attach to a urethane body that abuts a depth stopper, which attaches onto the body of the screwdriver bit. The urethane body has a hexagonally shaped hole through which the screwdriver bit passes through. The spring-loaded end piece only moves a small distance to accommodate the screw head and is composed of a urethane composite along with the urethane body. A spring imposes a biasing force on the urethane body and a pressure loading sleeve secured to the screwdriver bit. The hex drive screw holder supports a screw head against a screwdriver bit during installation into a work surface, and provides a means of ingress and egress of the screw to and from the spring-loaded end piece.

20 Claims, 5 Drawing Sheets

HEX DRIVE SCREW HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of screw drivers, more specifically, a screw driver that works in conjunction with a screw holder to insure that the screw head is not marred or damaged by slipping associated with rotation thereto.

B. Discussion of the Prior Art

As will be discussed immediately below, no prior art discloses a hex driven screw holder that includes a spring-loaded end piece having a slot across which the neck of a screw may slide and of which engages and aligns the screw head against the screw driver bit; wherein the spring-loaded end piece is supported by opposing arms that attach to a urethane body that abuts a depth stopper, which attaches onto the body of the screw driver bit; wherein the spring-loaded end piece only moves a small distance to accommodate the screw head and is composed of a urethane composite along with the urethane body.

The Nick Patent (U.S. Pat. No. 5,341,708) discloses a fastener support apparatus for facilitating the installation of individual screws into a work surface that includes a rotatable bit for engaging the head of the screw. However, the fastener support apparatus does not include a spring-loaded end piece that includes a slot such that a screw head may be slid therein and aligned adjacent a screw bot, and which shall place a biasing force upon the head of the screw so as to support said screw during the driving process into the adjacent work surface.

The Nick Patent (U.S. Pat. No. 5,207,127) discloses a fastener support apparatus for facilitating the installation of individual screws into a work surface including means for driving individual screws into the work surface. However, the fastener support apparatus doe not feature a spring-loaded end piece that has a slot for sliding a head of a screw therethrough and aligned adjacent the screw bit, and in which the entire apparatus is inserted into and secured to a chuck of a drill.

The Goldstein Patent (U.S. Pat. No. 4,800,788) discloses a non-slip screwdriver. However, the screw driver does not support a screw from beneath the screw head so as to prevent unintended slipping, by providing a slot in a spring-loaded piece.

The Han Patent (U.S. Pat. No. 6,082,233) discloses a fastener holding device that is designed for use with power or hand tools. However, the device does not use a spring-loaded end piece that includes a slot such that the head of a screw may slide across at the neck of the screw, and which is aligned adjacent to a drill bit that imposes a biasing force onto the head of the screw so as to prevent slippage during installation into a work surface.

The Hsiao Patent Application Publication (U.S. Pub. No. 2006/0278050) discloses a holding chuck for fastening tools. However, the holding chuck relies upon a magnetic dome to attract the head of the screw, and does not use a spring-loaded end piece having a slot across which the head of the screw may slide into and be engaged upon by the bit.

The Chen Patent Application Publication (U.S. Pub. No. 2005/0166725) discloses a fastening component assisting positioning device. Again, the device relies upon magnetic attraction to support the screw ahead against the driving bit, and not a spring-loaded end piece having a slot to enable the screw head to be positioned under the screw driving bit.

The Chiang Patent (U.S. Pat. No. 5,996,452) discloses a chuck device for a power tool. Again, the chuck device does not include a slot into which the neck of the screw may pass across so as to align the head of the screw beneath the screw driving bit, which is biased thereon via the spring-loaded end piece.

The Parsons Patent (U.S. Pat. No. 4,936,169) discloses a device for positioning and applying fasteners, such as screws, to a work object. However, the device does not use a spring-loaded end piece having a slot across which the screw may pass in order to align the screw head against the screw driving bit.

The Nick Patent (U.S. Pat. No. 5,509,330) discloses a fastener support apparatus for facilitating the installation of individual screws into a work surface, and wherein the fastener support apparatus works in combination with a drive assembly having a clutch. However, the fastener support apparatus doe not feature a spring-loaded end piece that has a slot for sliding a head of a screw therethrough and aligned adjacent the screw bit, and in which the entire apparatus is inserted into and secured to a chuck of a drill.

While the above-described devices fulfill their respective and particular objects and requirements, they do not describe a hex driven screw holder that includes a spring-loaded end piece having a slot across which the neck of a screw may slide and of which engages and aligns the screw head against the screw driver bit; wherein the spring-loaded end piece is supported by opposing arms that attach to a urethane body that abuts a depth stopper, which attaches onto the body of the screw driver bit; wherein the spring-loaded end piece only moves a small distance to accommodate the screw head and is composed of a urethane composite along with the urethane body. In this regard, the hex drive screw holder departs from the conventional concepts and designs of the prior art.

SUMMARY OF THE INVENTION

The hex drive screw holder includes a spring-loaded end piece having a slot across which the neck of a screw may slide and of which engages and aligns the screw head against the screwdriver bit. The spring-loaded end piece is supported by opposing arms that attach to a urethane body that abuts a depth stopper, which attaches onto the body of the screwdriver bit. The urethane body has a hexagonally shaped hole through which the screwdriver bit passes through. The spring-loaded end piece only moves a small distance to accommodate the screw head and is composed of a urethane composite along with the urethane body. A spring imposes a biasing force on the urethane body and a pressure loading sleeve secured to the screwdriver bit. The hex drive screw holder supports a screw head against a screwdriver bit during installation into a work surface, and provides a means of ingress and egress of the screw to and from the spring-loaded end piece.

An object of the invention is to provide a device that supports a screw against a screwdriver bit, but which enables said screw to attach and detach without taking apart the device pursuant to the slot on the spring-loaded end piece.

A further object of the invention is to provide a hex drive screw holder in which the spring-loaded end piece is made of a urethane so as to provide the ideal amount of flexibility needed to insert and remove the screw with respect to the device.

An even further object of the invention is to provide a device that attaches to a chuck of a drill.

An even further object of the invention is to provide a spring-loaded end piece that includes a hinge pin opposite of a screw entrance such that the hinge pin can rotate to expand the screw entrance thereby enabling a screw to be inserted therein, and which shall return to a rest position thereafter.

These together with additional objects, features and advantages of the hex drive screw holder will be readily apparent to those of ordinary skill in the art upon reading the following detailed description of presently preferred, but nonetheless illustrative, embodiments of the hex drive screw holder when taken in conjunction with the accompanying drawings.

In this respect, before explaining the current embodiments of the hex drive screw holder in detail, it is to be understood that the hex drive screw holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hex drive screw holder.

It is therefore important that the claims be regarded as including such equivalent construction insofar as they do not depart from the spirit and scope of the hex drive screw holder. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
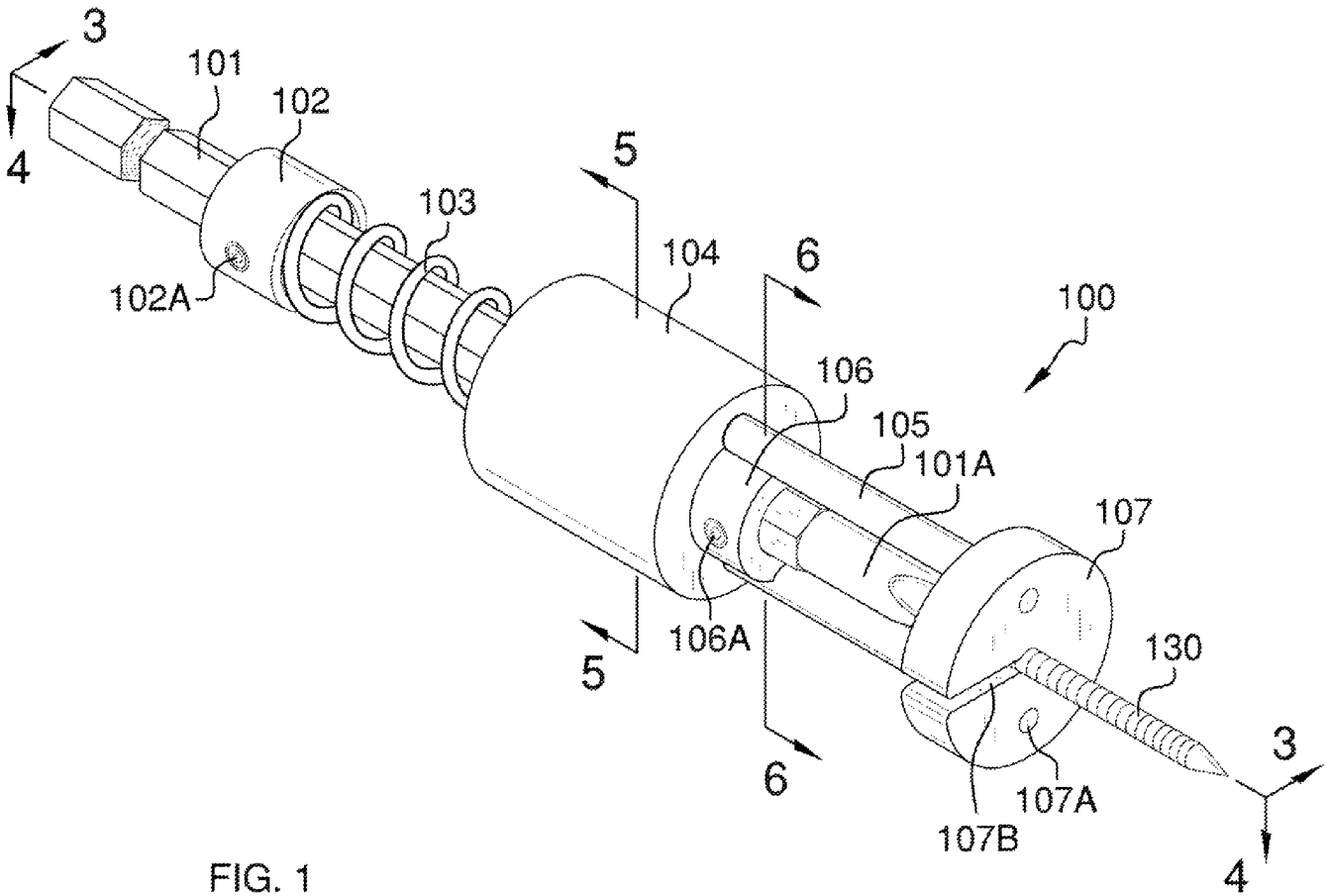
FIG. 1 illustrates a perspective view of the hex drive screw holder in which a screw is inserted into the spring-loaded end piece via the slot.
Figure 2:
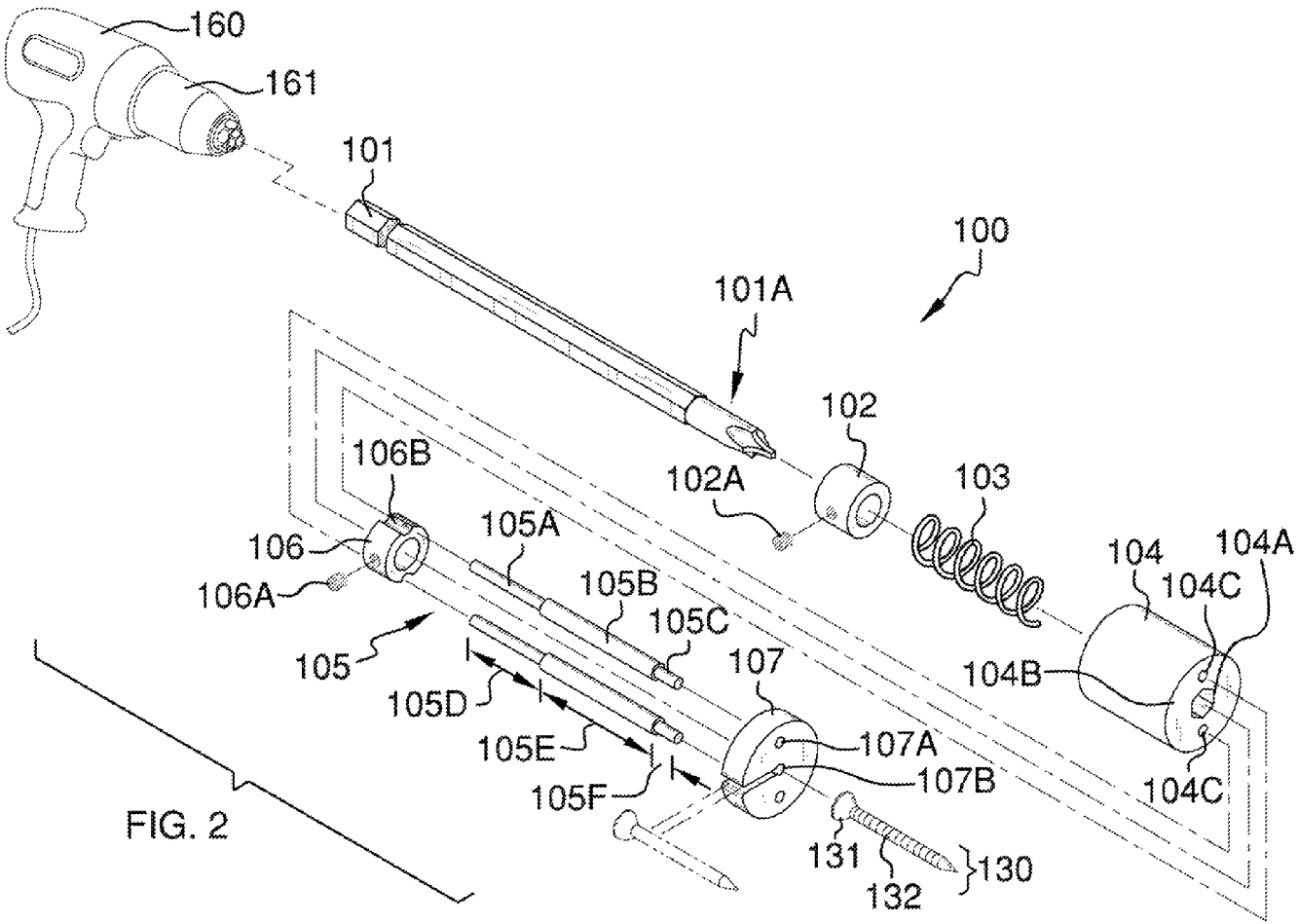
FIG. 2 illustrates an exploded view of the hex drive screw holder in order to depict the arrangement and orientation of the components as well as to visualize the neck of the screw sliding across the slot so as to align the screw head adjacent the screwdriver bit.

The following detailed description is merely exemplary in nature and is not intended to limit the described embodiments of the application and uses of the described embodiments. As used herein, the word "exemplary" or "illustrative" means "serving as an example, instance, or 'illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A hex drive screw holder 100 (hereinafter invention) includes a hex screwdriver bit 101 (hereinafter screwdriver bit). A pressure loading sleeve 102 is a collar-shaped object that slides onto the screwdriver bit 101 and is secured in place with respect to the screwdriver bit 101 via a set screw 102A. A spring 103 is placed onto the screw driver bit 101, and a urethane body 104 ensues.

The urethane body 104 has a hex-shaped hole 104A to enable the screwdriver bit 101 to slide therein. The urethane body 104 and the pressure-loading sleeve 102 abut each end of the spring 103 and are pushed away from one another via the spring 103.

The urethane body 104 is further defined by a first side 104B upon which two arm holes 104C are provided. Opposing arms 105 are inserted into the two arm holes 104C, and are secured to the urethane body 104.

A depth stopper 106 is another collar-shaped object that slides onto the screwdriver bit 101. The depth stopper 106 includes a second set screw 106A, which secures the depth stopper 106 onto the screwdriver bit 101. The depth stopper 106 includes grooves 106B on opposing sides, which accommodate the opposing arms 105 that attach to the urethane body 104 adjacent thereto.

A spring-loaded end piece 107 attaches to the opposing arms 105 via arm holes 107A. The spring-loaded end piece 107 includes a slot 107B that extends from a center of the spring-loaded end piece 107 radially, and which enables a screw 130 to pass therein.

Figure 3:
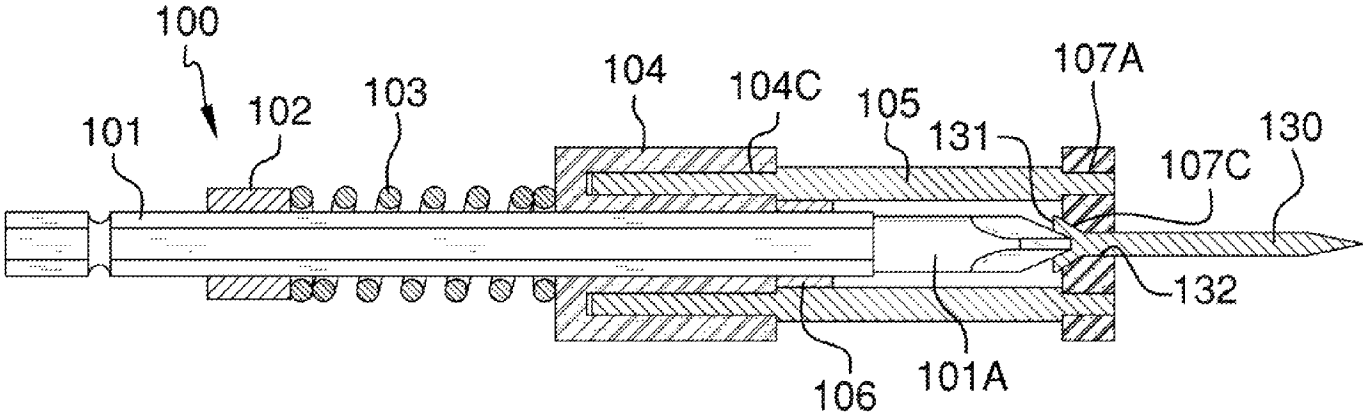
FIG. 3 illustrates a cross-sectional view of the hex drive screw holder along line 3-3 in FIG. 1, and depicting the arms connecting between the spring-loaded end piece and the urethane body and in which the screwdriver bit is engaged upon the head of the screw.
Figure 4:
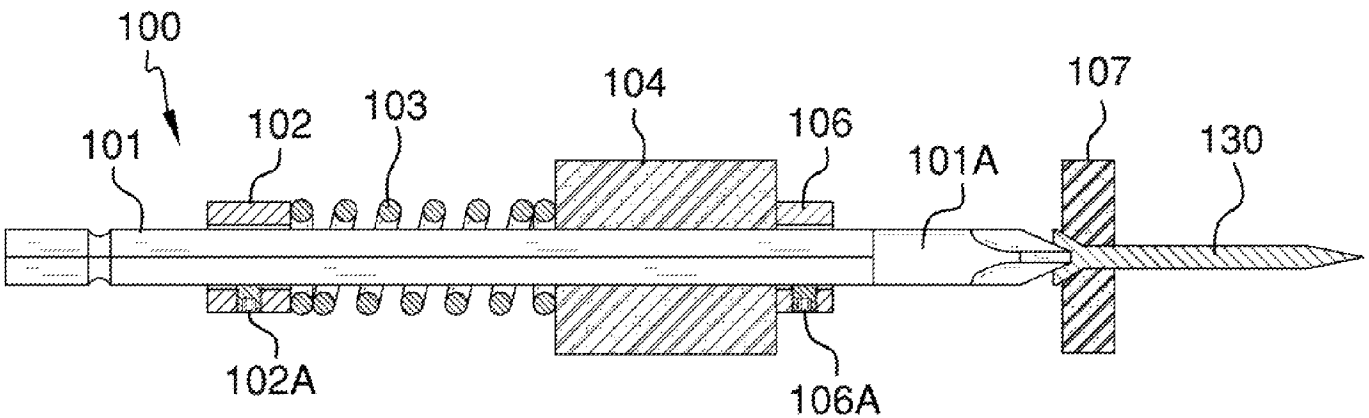
FIG. 4 illustrates a cross-sectional view of the hex drive screw holder along line 4-4 in FIG. 1, and detailing the set screws used to secure the depth stopper and pressure loading sleeve, which restrict the spring and urethane body therein.
Figure 3A:
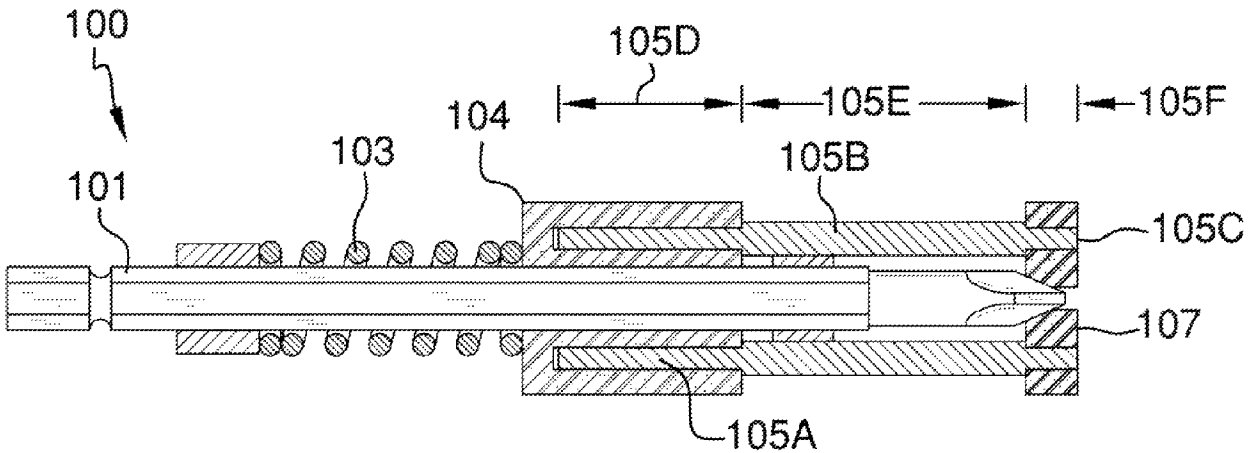
FIG. 3A illustrates the cross-sectional view of the hex drive screw holder along line 3-3 in FIG. 1, but in which the screw is removed from the hex drive screw holder

The spring-loaded end piece 107 features a concave notch 107C, which supports a head 131 of the screw 130 (see FIGS. 3-4). It shall be noted that the screwdriver bit 101 includes the bit 101A at a first end, and which is responsible for engaging the head 131 of the screw 130.

It shall be noted that the screw 130 includes a neck 132, which traverses the slot 1078 so that the head 132 may be pushed against the concave notch 107C of the spring-loaded end piece 107.

The opposing arms 105 include a first end 105A, a middle portion 105B, and a second end 105C. The first end 105A and the second end 105C have the same diameter, which is less than the diameter of the middle portion 105B. The first end 105A is defined by a distance 105D, which is less than a distance 105E of the middle portion 105B; whereas the second end 105C has a distance 105F that is less than the distance 105D.

The screwdriver bit 101 may be inserted into a chuck 161 of a drill 160, and used to drive the screw 130 into a work surface. The spring-loaded end piece 107 supports the screw 130, and the head 131 of the screw 130 against the bit 101A of the screwdriver bit 101 during use with the drill 160.

It shall be noted that the spring-loaded end piece 107 may be made of a urethane having enough flexibility to enable the screw 130 to slide in and out of the spring-loaded end piece 107 via the slot 107B.

It shall be noted that the spring 103 insures that the urethane body 104 is pushed up against the depth stopper 06, whereby producing a clearance between an end of the bit 101A and the spring-loaded end piece 107, which is needed to ensure that the appropriate amount of biasing force is placed from the bit 101A onto the head 131 of the screw 130.

Figure 7:
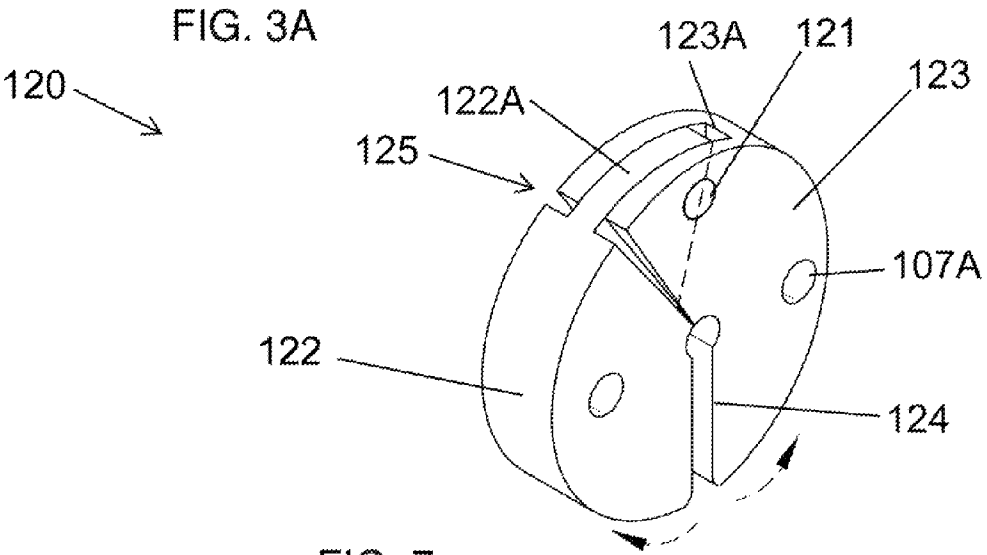
FIG. 7 illustrates a perspective view of an alternative embodiment of the spring-loaded end piece including a hinge pin that rotates to enlarge the screw entrance as denoted by the curved arrows.
Figure 5:
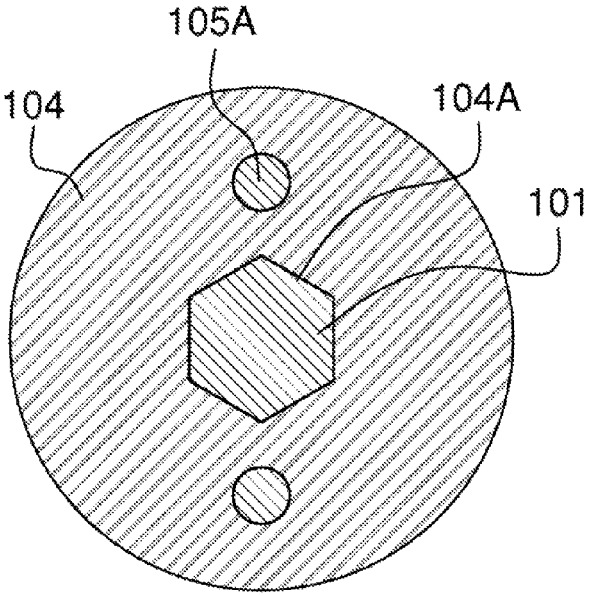
FIG. 5 illustrates a cross-sectional view of the hex drive screw holder along line 5-5 in FIG. 1 and depicting the urethane body and opposing arms as well as the screwdriver bit passing along the center.
Figure 6:
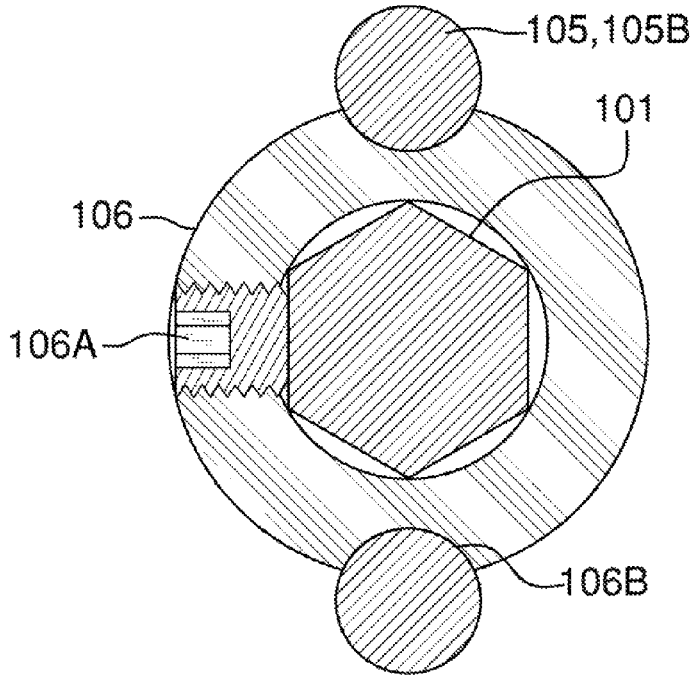
FIG. 6 illustrates a cross-sectional view of the hex drive screw holder along line 6-6 in FIG. 1, and depicting the set screw securing the depth stopper to the screwdriver bit as well as the curved grooves on opposing sides of the depth stopper, which support the opposing arms.

Referring to FIG. 7, an alternative embodiment 120 of the spring-loaded end piece includes a hinge pin 121 that is transfixed between a first body 122 and a second body 123. Both the first body 122 and the second body 123 form a slot 124 into which the screw 130 slides therein in order to be seated against the screwdriver bit 101. However, it shall be noted that the hinge pin 121 enables the first body 122 to rotate a predefined portion with respect to the second body 123 such that the slot 124 is enlarged. The hinge pin 121 connects the first body 122 to the second body 123. The first body 122 includes a male pivot arm 122A whereas the second body 123 includes a female notch 123A. Upon alignment of the male pivot arm 122A and the female notch 123A, the hinge pine 121 slides therein. The shape of the male pivot arm 122A and the female notch 123A provide a gap 125 that limits the amount of rotation of the first body 122 with respect to the second body 123 thereby limiting the range of enlargement of the slot 124.

The first body 122 and the second body 123 both include arm holes 107A as with the spring-loaded end piece 107 described above. The second embodiment 120 of the spring-loaded end piece features all of the characteristics of the spring-loaded end piece 107 described above, with the exception to the hinge pin 121 and rotation of the first body 122 with respect to the second body 123.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A hex drive screw holder comprising:

a screwdriver bit upon which a pressure loading sleeve is secured thereon;

a spring is located between the pressure loading sleeve and a urethane body;

wherein a depth stopper is secured on the screwdriver bit so as to sandwich the urethane body and the spring between the depth stopper and the pressure loading sleeve;

wherein opposing arms extend from the urethane body and support a spring-loaded end piece thereon;

wherein the spring-loaded end piece includes a slot that enables a screw to slide therein so as to align a head of said screw adjacent a bit of the screwdriver bit;

wherein the spring places a biasing force against the urethane body, which is pushed against the depth stopper, whereby producing a clearance between an end of the screwdriver bit and the spring-loaded end piece, which is needed to ensure that the appropriate amount of biasing force is placed from the screwdriver bit onto the head of the screw.

2. The hex drive screw holder as described in claim 1 wherein the pressure loading sleeve is a collar-shaped object, which secures onto the hex screwdriver bit via a set screw.

3. The hex drive screw holder as described in claim 2 wherein the urethane body has a hex-shaped hole that enables the screwdriver bit to slide therein.

4. The hex drive screw holder as described in claim 3 wherein the urethane body has a first side upon which two arm holes are provided so that the opposing arms attach.

5. The hex drive screw holder as described in claim 4 wherein the depth stopper is a collar-shaped object that slides onto the screwdriver bit and includes a second set screw, which secures the depth stopper onto the screwdriver bit.

6. The hex drive screw holder as described in claim 5 wherein the depth stopper includes grooves on opposing sides, which accommodate the opposing arms that attach to the urethane body adjacent thereto.

7. The hex drive screw holder as described in claim 6 wherein the spring-loaded end piece includes a concave notch, which supports a head of the screw.

8. The hex drive screw holder as described in claim 1 wherein the opposing arms include a first end, a middle portion, and a second end.

9. The hex drive screw holder as described in claim 8 wherein the first end and the second end have the same diameter, which is less than the diameter of the middle portion.

10. The hex drive screw holder as described in claim 9 wherein the first end is defined by a distance, which is less than a distance of the middle portion; whereas the second end has a distance that is less than the distance.

11. The hex drive screw holder as described in claim 1 wherein the screwdriver bit is inserted into a chuck of a drill, and used to drive the screw into a work surface; wherein the spring-loaded end piece supports the screw, and the head of the screw against the bit of the screwdriver bit during use with the drill.

12. The hex drive screw holder as described in claim 1 wherein the spring-loaded end piece is further defined by a hinge pin transfixed between a first body and a second body; wherein the slot is defined between the first body and the second body; wherein the hinge pin provides a predefined amount of rotational movement of the first body with respect to the second body thereby enlarging the slot formed there between.

13. A hex drive screw holder comprising:

a screwdriver bit upon which a pressure loading sleeve is secured thereon;

a spring is located between the pressure loading sleeve and a urethane body;

wherein a depth stopper is secured on the screwdriver bit so as to sandwich the urethane body and the spring between the depth stopper and the pressure loading sleeve;

wherein opposing arms extend from the urethane body and support a spring-loaded end piece thereon;

wherein the spring-loaded end piece includes a slot that enables a screw to slide therein so as to align a head of said screw adjacent a bit of the screwdriver bit;

wherein the spring places a biasing force against the urethane body, which is pushed against the depth stopper, whereby producing a clearance between an end of the screwdriver bit and the spring-loaded end piece, which is needed to ensure that the appropriate amount of biasing force is placed from the screwdriver bit onto the head of the screw;

wherein the screwdriver bit is inserted into a chuck of a drill, and used to drive the screw into a work surface; wherein the spring-loaded end piece supports the screw, and the head of the screw against the bit of the screwdriver bit during use with the drill.

14. The hex drive screw holder as described in claim 13 wherein the pressure loading sleeve is a collar-shaped object, which secures onto the hex screwdriver bit via a set screw; wherein the urethane body has a hex-shaped hole that enables the screwdriver bit to slide therein.

15. The hex drive screw holder as described in claim 14 wherein the urethane body has a first side upon which two arm holes are provided so that the opposing arms attach; wherein the depth stopper is a collar-shaped object that slides onto the screwdriver bit and includes a second set screw, which secures the depth stopper onto the screwdriver bit.

16. The hex drive screw holder as described in claim 15 wherein the depth stopper includes grooves on opposing sides, which accommodate the opposing arms that attach to the urethane body adjacent thereto.

17. The hex drive screw holder as described in claim 16 wherein the spring-loaded end piece includes a concave notch, which supports a head of the screw.

18. The hex drive screw holder as described in claim 13 wherein the opposing arms include a first end, a middle portion, and a second end; wherein the first end and the second end have the same diameter, which is less than the diameter of the middle portion; wherein the first end is defined by a distance, which is less than a distance of the middle portion; whereas the second end has a distance that is less than the distance.

19. The hex drive screw holder as described in claim 13 wherein the spring-loaded end piece may be made of a urethane that provides flexibility to enable the screw to slide in and out of the spring-loaded end piece via the slot.

20. The hex drive screw holder as described in claim 13 wherein the spring-loaded end piece is further defined by a hinge pin transfixed between a first body and a second body; wherein the slot is defined between the first body and the second body; wherein the hinge pin provides a predefined amount of rotational movement of the first body with respect to the second body thereby enlarging the slot formed there between.

* * * * *